US006809278B2

(12) United States Patent
Tsubaki

(10) Patent No.: US 6,809,278 B2
(45) Date of Patent: Oct. 26, 2004

(54) ELECTRONIC EQUIPMENT AND PUSHBUTTON USED THEREIN

(75) Inventor: Yasuhiro Tsubaki, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/802,849

(22) Filed: Mar. 18, 2004

(65) Prior Publication Data

US 2004/0182687 A1 Sep. 23, 2004

(30) Foreign Application Priority Data

Mar. 18, 2003 (JP) ..... P2003-073162

(51) Int. Cl.[7] ..... H01H 13/14
(52) U.S. Cl. ..... 200/341; 200/345; 200/314
(58) Field of Search ..... 200/310, 313, 200/314, 341, 345, 5 A, 296, 520

(56) References Cited

U.S. PATENT DOCUMENTS 4,439,646 A * 3/1984 Bouvrande ..... 200/5 A
5,173,578 A * 12/1992 Tama ..... 200/345
6,133,539 A * 10/2000 Yao ..... 200/517
6,284,992 B1 * 9/2001 Richter ..... 200/344
6,590,176 B2 * 7/2003 Cole et al. ..... 200/341
6,603,083 B2 * 8/2003 Amari et al. ..... 200/5 D

FOREIGN PATENT DOCUMENTS

JP 59-069439 4/1984

* cited by examiner

*Primary Examiner*—Michael A. Friedhofer
(74) *Attorney, Agent, or Firm*—Browdy and Neimark, P.L.L.C.

(57) ABSTRACT

The electronic equipment makes manipulation surface of a pushbutton accurately project through a button hole formed in a face panel and can prevent play of the pushbutton even when positioning accuracy of the button hole is poor. The electronic equipment is configured such that an outer button and an inner button are mounted in a state that the buttons are movable relative to each other and engaging projections formed on the outer button are respectively positioned to engaging holes formed in the face panel. Due to such a constitution, even when an axis of the button hole of the face panel and an axis of a guide portion of a chassis are displaced form each other, it is possible to make a manipulation surface of the outer button accurately project through the button hole and, at the same time, it is possible to prevent play of the outer button.

6 Claims, 3 Drawing Sheets

ELECTRONIC EQUIPMENT AND PUSHBUTTON USED THEREIN

BACKGROUND OF THE INVENTION

1. Field of the Invention

The present invention relates to electronic equipment which with a pushbutton mounted on a panel thereof.

2. Description of the Related Art

FIG. 1 shows the constitution of a pushbutton used in conventional electronic equipment of this type. In FIG. 1, the electronic equipment on which the pushbutton is mounted includes a pushbutton 103 which has a manipulation surface 103*a* thereof projected from a button hole 102 formed in a face panel 101; a chassis 104 which has a guide portion 104*a* which slidably guides an angled cylindrical barrel portion 103*b* of the pushbutton 103, a board 106 which is fixed to the chassis 104 by mounting screws 105, a rubber contact switch 107 which is mounted on the board 106 and operated when a distal end portion of the barrel portion 103*b* of the pushbutton 103 pushes the rubber contact switch 107, and an LED (light emitting diode) 108 which is mounted on a circuit of the board 106. The LED 108 is arranged between a pair of fixed contacts 107*b* of the rubber contact switch 107. When an operator pushes the manipulation surface 103*a* of the pushbutton 103, movable contacts 107*a* of the rubber contact switch 107 are pushed by the distal end portion of the barrel portion 103*b* and hence, the movable contacts 107*a* are brought into contact with and become conductive with the fixed contacts 107*b* on the board 106 whereby given functional portions are operated and, at the same time, the LED 108 is lit or turned on and letters and symbols formed on an illumination portion 103*b* on the manipulation surface 103*a* of the pushbutton 103 are illuminated.

A task to be solved with respect to the electronic equipment provided with such a pushbutton is the alignment of an axis of the guide portion 104*a* of the chassis 104 and an axis of the button hole 102 formed in the face panel 101. When these axes are not aligned with each other due to a dimensional error or a mounting error, the manipulation surface 103*a* of the pushbutton 103 does not accurately project from the button hole 102 formed in the face panel 101. That is, there may be a case that the manipulation surface 103*a* is caught by a periphery of the button hole 102 leading to a defective operation. Further, in a worst case, it is impossible to make the pushbutton 103 project from the button hole 102. In view of the above drawbacks, conventionally, there has been known the structure in which an intermediate member is arranged between the pushbutton 103 and the chassis 104 and play is formed between the pushbutton 103 and the intermediate member, whereby irregularities of the dimensional error or the mounting error can be absorbed by the play (for example, Japanese Unexamined Utility Model Publication No. Sho 59-69439 (pages 3 to 6, FIG. 2)).

However, in the abovementioned conventional structure which absorbs the irregularities of the dimensional error or the mounting error, the pushbutton has play and hence, there have been drawbacks that the pushbutton tilts in a pushbutton hole, the pushbutton generates weird noise, and the manipulation feeling is poor. Particularly, when the face panel is made of wood, it is difficult to obtain the dimensional accuracy with respect to the positional accuracy of the button hole compatible to the corresponding dimensional accuracy obtainable in forming the button hole in a metal sheet or resin molded product and hence, the abovementioned drawback becomes more noticeable.

The present invention has been made to solve the abovementioned drawbacks and it is an object of the present invention to provide electronic equipment and a pushbutton to be used in such electronic equipment which can make the pushbutton accurately project from a button hole and can prevent play even when the positional accuracy of the button hole formed in a face panel is poor.

SUMMARY OF THE INVENTION

To achieve the abovementioned object, electronic equipment according to the present invention includes an outer button which has a manipulation surface which can be manipulated through a button hole formed in a panel, an inner button which is mounted inside the outer button such that the inner button is movable relative to the outer button, a chassis which has a guide portion for slidably guiding the inner button, a switch which is mounted on a board fixed to the chassis and is operated by the inner button, and positioning means which position the outer button with respect to the panel. Due to such a constitution, since the outer button is movable with respect to the inner button which is fixed to the chassis, even when the positional accuracy of the button hole formed in the panel is poor, it is possible to make the manipulation surface of the outer button accurately project through the button hole and, at the same time, it is possible to prevent play of the outer button due to the provision of the positioning means.

Further, in the electronic equipment of the present invention, the positioning means include an engaging portion which is integrally formed with the outer button and a portion to be engaged which is formed in the panel and is engageable with the engaging portion. Due to such a constitution, it is possible to easily implement the positioning means.

Further, in the electronic equipment of the present invention, the engaging portion is constituted of a pair of engaging projections which are formed on both sides of the outer button and the portion to be engaged is constituted of a pair of engaging holes which are engageable with the pair of engaging projections. Due to such a constitution, positioning of the outer button with respect to the panel can be performed without play.

Further, in the electronic equipment of the present invention, the manipulation surface of the outer button is inclined in a longitudinal direction with respect to the chassis, and, of the pair of engaging projections, the engaging projection which is away from the chassis with a shorter distance projects in a sideward direction of the outer button and the engaging projection which is away from the chassis with a longer distance projects upward from a side of the outer button. Due to such a constitution, even when the outer button is inclined in the longitudinal direction with respect to the chassis, it is possible to ensure positioning of the outer button with respect to the panel and hence, it is possible to cope with various designs of the outer buttons.

Further, in the electronic equipment of the present invention, an illumination portion is formed on the manipulation surface of the outer button, the inner button is made of a light guiding material, and a light emitting diode is arranged to face the inner button in an opposed manner. Due to such a constitution, even when the illumination portion of the outer button is arranged at a position remote from the light emitting diode, it is possible to effectively illuminate the illumination portion of the outer button through the inner button made of the light guiding material.

Further, a pushbutton according to the present invention includes an outer button which has a manipulation surface, an inner button which is mounted inside the outer button such that the inner button is movable relative to the outer button, an engaging portion which is formed on an outer side of the outer button for positioning the outer button with respect to the panel, and an engaging portion which is formed on a barrel portion of the inner button for mounting the inner button on a chassis. Due to such a constitution, in inserting the barrel portion of the inner button of the pushbutton into a guide portion of the chassis and projecting the manipulation surface of the outer button through a button hole formed in the panel, even when the positional accuracy of the button hole formed in the panel is poor, it is possible to make the manipulation surface of the outer button accurately project through the button hole formed in the panel and, at the same time, it is possible to prevent play of the outer button with respect to the panel.

As has been explained heretofore, electronic equipment according to the present invention includes an outer button which has a manipulation surface which can be manipulated through a button hole formed in a panel, an inner button which is mounted inside the outer button such that the inner button is movable relative to the outer button, a chassis which has a guide portion for slidably guiding the inner button, a switch which is mounted on a board fixed to the chassis and is operated by the inner button, and positioning means which position the outer button with respect to the panel. Accordingly, even when the positional accuracy of the button hole formed in the panel is poor, it is possible to make the manipulation surface of the outer button accurately project through the button hole and, at the same time, it is possible to prevent play of the outer button due to the provision of the positioning means.

DESCRIPTION OF THE PREFERRED EMBODIMENT

Figure 1:
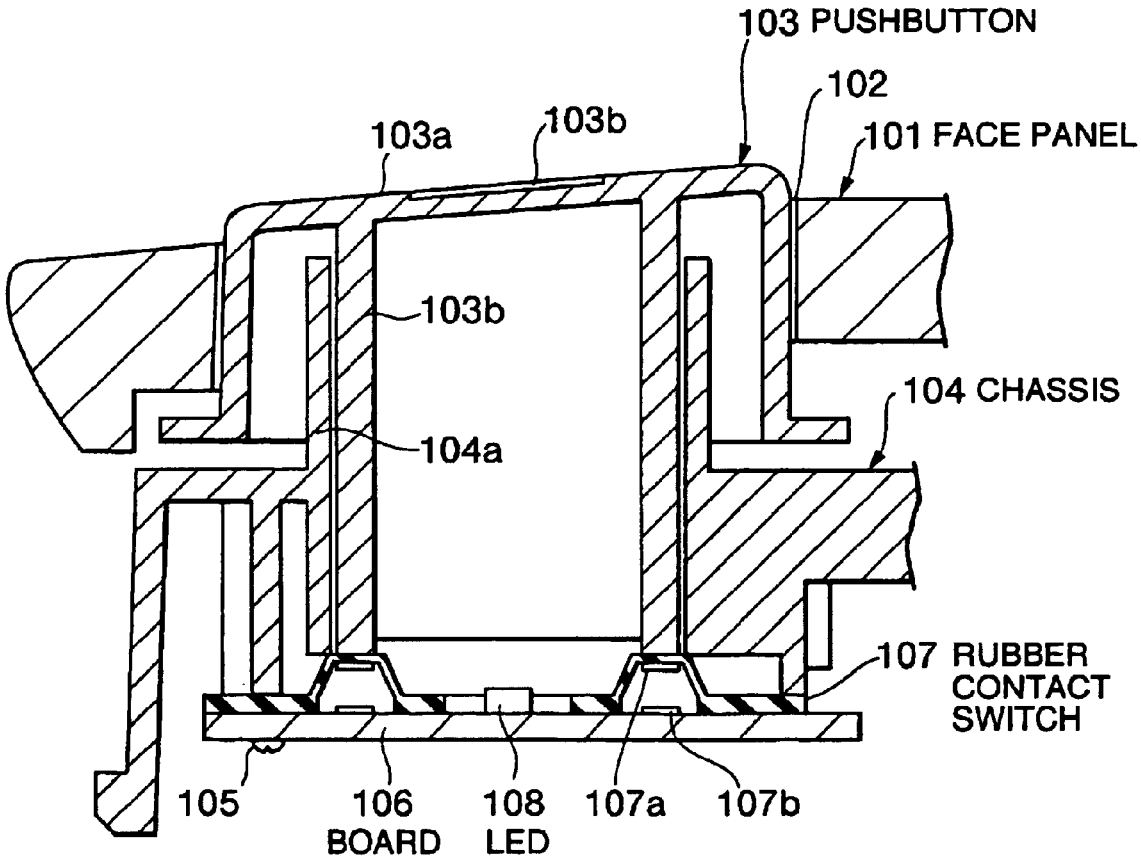
FIG.1 RELATED ART
FIG. 1 is a schematic cross-sectional view showing the constitution of a pushbutton portion of electronic equipment as a conventional example.
Figure 2:
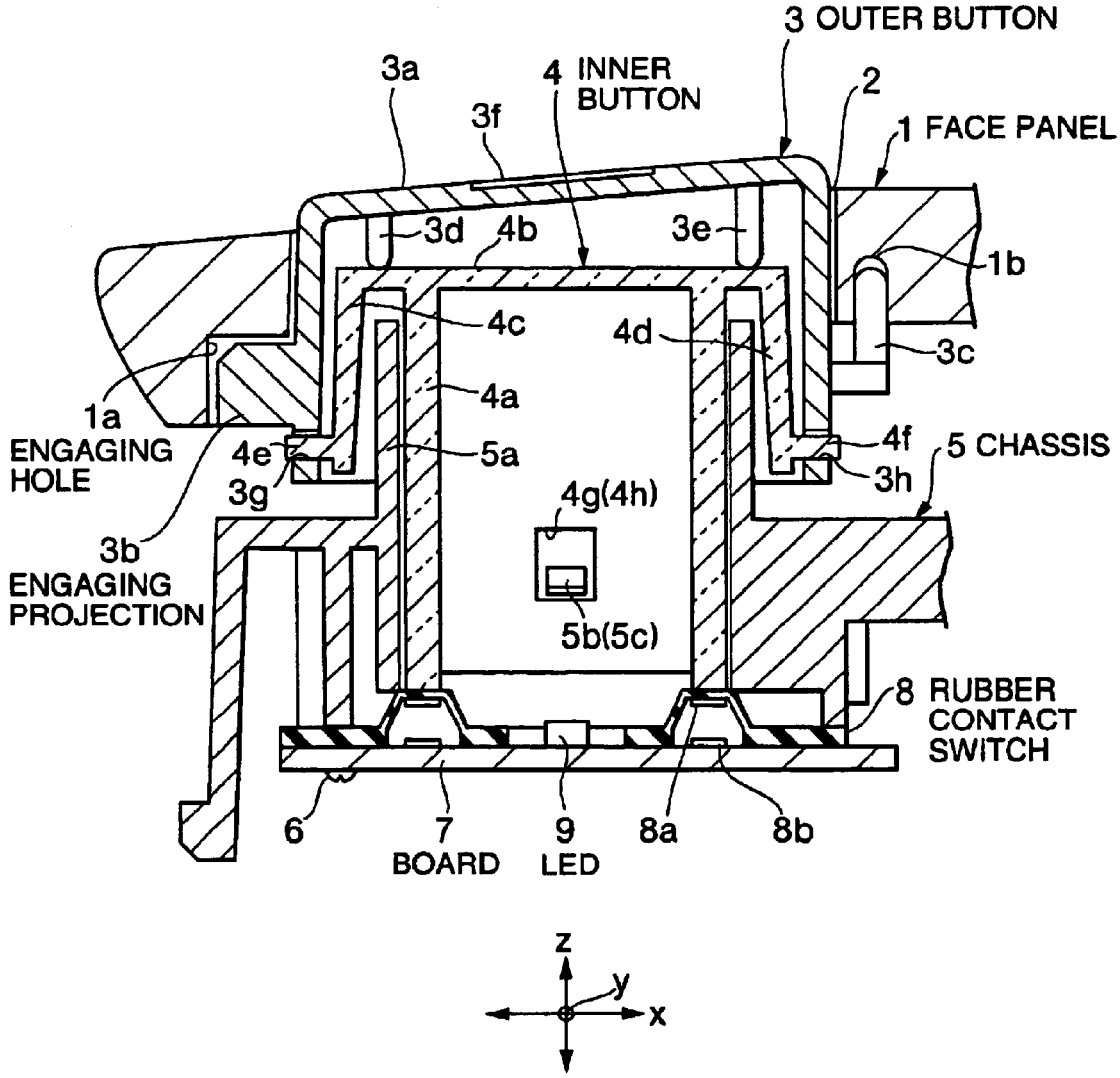
FIG. 2 is a schematic cross-sectional view showing the constitution of a pushbutton portion of electronic equipment in one embodiment of the present invention.
Figure 3:
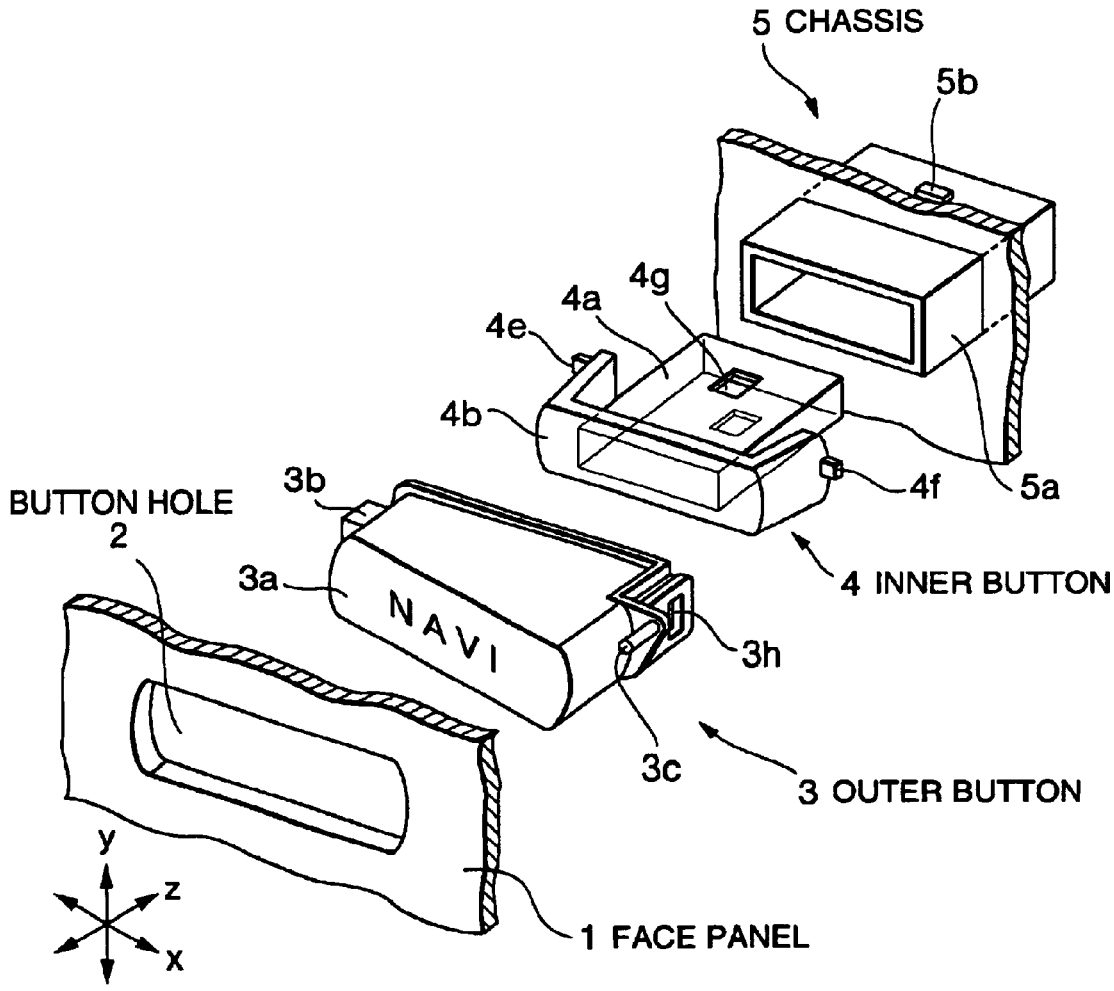
FIG. 3 is a schematic exploded perspective view showing the constitution of a pushbutton portion of electronic equipment in one embodiment of the present invention.

A preferred embodiment of the present invention is explained in detail in conjunction with drawings. FIG. 2 is a schematic cross-sectional view showing the constitution of a pushbutton portion of electronic equipment according to one embodiment of the present invention and FIG. 3 is an exploded perspective view thereof. In FIG. 2, this electronic equipment is applied to a center console in a vehicle cabin and includes an outer button 3 which has a manipulation surface 3*a* projecting through a button hole 2 formed in a face panel 1 of the console, an inner button 4 which is mounted inside the outer button 3 such that the inner button 4 is movable relative to the outer button 3, a chassis 5 which includes a guide portion 5*a* which slidably guides an angled cylindrical barrel portion 4*a* of the inner button 4, a board 7 which is fixed to the chassis 5 by mounting screws 6, a rubber contact switch 8 which is arranged on the board 7 and operated when the rubber contact switch 8 is pushed by a distal end portion of the barrel portion 4*a* of the inner button 4, and an LED (light emitting diode) 9 which is mounted on a circuit of the board 7. The LED 9 is arranged between a pair of fixed contacts 8*b* of the rubber contact switch 8 such that the LED 9 faces a center portion of the barrel portion 4*a* of the inner button 4 in an opposed manner.

The outer button 3 is made of a semitransparent resin material and is formed into a rectangular box shape by molding, wherein the manipulation surface 3*a* is inclined in the longitudinal direction such that an end portion side of the outer button 3 becomes low with respect to the chassis 5. Further, with respect to both side surfaces of the outer button 3 in the x direction which is the longitudinal direction, on one side surface of the outer button 3 where a distance from the chassis 5 is short, a block-like engaging projection 3*b* is formed such that the projection 3*b* projects sideward, while on another side surface of the outer button 3 where a distance from the chassis 5 is long, a pin-like engaging projection 3*c* is formed in a state that the projection 3*c* projects upward from the side of the outer button 3. The engaging projection 3*b* is positioned at an approximately center portion of one side surface of the outer button 3, while the engaging projection 3*c* projects from a corner of another side surface of the outer button 3. Then, in a back surface of the face panel 1, at positions which face these engaging projections 3*b*, 3*c*, engaging holes 1*a*, 1*b* are respectively formed. These engaging projections 3*b*, 3*c* and the engaging holes 1*a*, 1*b* constitute the positioning means of the outer button 3. Further, on an inner side of the manipulation surface 3*a* of the outer button 3, a pair of stopper projections 3*d*, 3*e* which position the inner button 4 with respect to the outer button 3 in the z direction which is the height direction are formed. On a front side of the manipulation surface 3*a*, letters or symbols are formed in an illumination portion 3*f*. These letters or symbols may be formed by exposing the inner semitransparent resin material by shaving off a surface coating of the manipulation surface 3*a* by laser cutting.

The inner button 4 is made of a resin material having a light guiding property and is formed by molding. A top portion 4*b* which supports a flattened box-like barrel portion 4*a* extends in the x direction beyond a guide portion 5*a* of the chassis 5 and arm portions 4*c*, 4*d* are downwardly formed from both end portions of the top portion 4*b*. Engaging pawls 4*e*, 4*f* are formed on distal end portions of the arm portions 4*c*, 4*d* such that the engaging pawls 4*e*, 4*f* extend laterally and outwardly. On the other hand, in lower end portions of both side surfaces of the outer button 3, engaging holes 3*g*, 3*h* are formed at positions which face these engaging pawls 4*e*, 4*f* in an opposed manner. The engaging holes 3*g*, 3*h* are formed of elongated holes which are elongated in the y direction which is a direction perpendicular to a plane of this sheet in FIG. 2 and hence, the outer button 3 is movable in the x, y directions relative to the inner button 4. Further, at center portions of lower portions of both side surfaces of the barrel portion 4*a* of the inner button 4 in the y direction, rectangular engaging holes 4*g*, 4*h* are formed and these engaging holes 4*g*, 4*h* are engageable with engaging pawls 5*b*, 5*c* formed on the chassis 5. Here, the positions of the engaging projections 3*b*, 3*c* formed on the outer button 3 are not limited to the abovementioned positions and can be arbitrarily set in view of the relationship between the outer button 3 and the face panel 1 and the like.

Next, the assembling and the manner of operation of the electronic equipment of this embodiment are explained. First of all, the chassis 5 to which the board 7 is fixed is mounted in a mounting hole formed in the center console of the vehicle. Next, the inner button 4 is pushed into the inside of the outer button 3. In such a pushing operation, the arm portions 4*c*, 4*d* at both sides of the inner button 4 are deflected inwardly and the engaging pawls 4*e*, 4*f* formed on the distal end portions of the arm portions 4*c*, 4*d* are engaged with the engaging holes 3*g*, 3*h* formed in the outer button 3. Since the play is present in the x, y directions in such an engagement, the outer button 3 and the inner button 4 are movable relative to each other. Next, when the barrel portion 4*a* of the inner button 4 to which the outer button 3 is assembled is inserted by pushing into the inside of the guide portion 5*a* of the chassis 5, the engaging holes 4*g*, 4*h* formed in the inner button 4 are engaged with the engaging pawls 5*b*, 5*c* formed on the chassis 5 and hence, the assembled body of the outer button 3 and the inner button 4 is mounted on the chassis 5. Then, the face panel 1 is mounted over the assembled body by positioning the face panel 1 such that the manipulation surface 3*a* of the outer button 3 projects through the button hole 2 formed in the face panel 1. Here, even when an axis of the guide portion 5*a* of the chassis 5 and an axis of the button hole 2 formed in the face panel 1 are displaced from each other, since the outer button 3 is configured to be movable relative to the inner button 4, the outer button 3 moves while following or tracing the button hole 2 formed in the face panel 1. Further, the engaging projections 3*b*, 3*c* of the outer button 3 are respectively fitted into the engaging holes 1*a*, 1*b* formed in the face panel 1 so that the play of the outer button 3 is prevented. Then, after completion of assembling, when an accessory switch of the vehicle is turned on and the manipulation surface 3*a* of the outer button 3 is pushed, the rubber contact switch 8 is pushed by the distal end portion of the barrel portion 4*b* of the inner button 4 and hence, the movable contacts 8*a* are brought into contact with the fixed contacts 8*b* on the board 7 and become conductive with the fixed contacts 8*b*. Accordingly, given functional parts are operated and, at the same time, the LED 9 is turned on and light which passes through the inner-button 4 having the light guiding property is emitted from the top portion 4*b* so as to illuminate the letters and the like of the illumination portion 3*f* formed on the manipulation surface 3*a* of the outer button 3.

In this manner, according to this embodiment, the outer button 3 and the inner button 4 are mounted in a state that these buttons 3, 4 are movable relative to each other and, at the same time, the engaging projections 3*b*, 3*c* of the outer button 3 are respectively positioned at the engaging holes 1*a*, 1*b* of the face panel 1. Accordingly, even when the axis of the button hole 2 of the face panel 1 and the axis of the guide portion 5*a* of the chassis 5 are displaced from each other, it is possible to make the manipulation surface 3*a* of the outer button 3 accurately project through the button hole 2 and, at the same time, it is possible to prevent the play of the outer button 3. Particularly, when the wooden panel is used to impart high-grade feeling to the face panel 1, the positioning accuracy in forming the button hole 2 inevitably becomes low (since the blanking which can be applied to a metal panel cannot be applied to a wooden panel). This embodiment is particularly effective in such a case where the positioning accuracy in forming the button hole in the wooden panel and the like is low. In the same manner, also with respect to the metal panel or the resin panel, this embodiment is particularly effective when it is difficult to ensure the sufficient positioning accuracy of the button hole.

In the abovementioned embodiment, the positioning means is constituted of the engaging projections 3*b*, 3*c* (engaging portions) which are formed on the outer button 3 and the engaging holes 1*a*, 1*b* (portions to be engaged) formed in the face panel 1. However, as another method, the engaging holes may be formed in the outer button 3 and the engaging projections may be formed on the face panel 1. Further, although the pair of engaging projections 3*b*, 3*c* are formed on both sides of the outer button 3 in this embodiment, the engaging projection may be formed on only one side of the outer button 3. Further, although the manipulation surface 3*a* of the outer button 3 is inclined with respect to the chassis 5 in this embodiment, the present invention is applicable to the outer button having the manipulation surface which is not inclined. Further, the illumination portion 3*f* is formed on the manipulation surface 3*a* of the outer button 3 in this embodiment, the present invention is applicable to the outer button having no illumination portion. Still further, in this embodiment, as the engaging means for mounting the inner button 4 on the chassis 5, the engaging holes 4*g*, 4*h* are formed in the inner button 4 and the engaging pawls 5*b*, 5*c* are formed on the chassis 5. However, as another method, the engaging pawls may be formed on the inner button 4 and the engaging holes may be formed on the chassis 5.

As has been explained heretofore, according to the electronic equipment of the present invention, even when the positioning accuracy of the button hole formed in the panel is poor, it is possible to make the manipulation surface of the outer button accurately project through the button hole and, at the same time, it is possible to prevent the play of the outer button using the positioning means.

Although the invention has been explained in conjunction with the preferred embodiment shown in the drawings, it is evident that the various other embodiments and modifications can be made without departing from the concept of the present invention. The present invention includes other embodiments and modifications.

What is claimed is:

1. Electronic equipment comprising:

an outer button which has a manipulation surface which can be manipulated through a button hole formed in a panel, an inner button which is mounted inside said outer button such that said inner button is movable relative to said outer button;

a chassis which has a guide portion for slidably guiding said inner button;

a switch which is mounted on a board fixed to said chassis and is operated by said inner button; and positioning means which positions said outer button with respect to said panel.

2. The electronic equipment according to claim 1, wherein said positioning means include an engaging portion which is integrally formed with said outer button and a portion to be engaged which is formed in said panel and is engageable with said engaging portion.

3. The electronic equipment according to claim 2, wherein said engaging portion is constituted by a pair of engaging projections which are formed on sides of said outer button and said portion to be engaged is constituted of a pair by engaging holes which are engageable with said pair of engaging projections.

4. The electronic equipment according to claim 3, wherein the manipulation surface of said outer button is inclined in a longitudinal direction with respect to said chassis, and, of said pair of engaging projections, the engaging projection which is away from said chassis by a shorter distance projects in a sideward direction of said outer button and said engaging projection which is away from said chassis by a longer distance projects upward from a side of said outer button.

5. The electronic equipment according to claim 1, wherein an illumination portion is formed on the manipulation surface of said outer button, said inner button is made of a light guiding material, and a light emitting diode is arranged to face said inner button in an opposed manner.

6. A pushbutton comprising:

an outer button which has a manipulation surface;

an inner button which is mounted inside said outer button such that said inner button is movable relative to said outer button;

an engaging portion which is formed on an outer side of said outer button for positioning said outer button with respect to a panel; and an engaging portion which is formed on a barrel portion of said inner button for mounting said inner button on a chassis.

* * * * *